United States Patent [19]

Fontana

[11] 4,186,503

[45] Feb. 5, 1980

[54] GREETING CARD DISPLAY ASSEMBLY AND METHOD

[76] Inventor: Paul Fontana, 2819 Jackson St., San Francisco, Calif. 94115

[21] Appl. No.: 937,476

[22] Filed: Aug. 28, 1978

[51] Int. Cl.[2] ..... G09F 1/10

[52] U.S. Cl. ..... 40/124.4; 211/196; 428/18; 428/20; D11/118

[58] Field of Search ..... 40/124.4, 124, 124.2, 40/124.1, 539, 19.5; 428/18, 19, 20; D11/118; 211/50, 52, 196

[56] References Cited

U.S. PATENT DOCUMENTS

| | | | |
|---|---|---|---|
| D. 130,937 | 12/1941 | Dennison | D11/118 |
| D. 205,392 | 7/1966 | Mifsud | D11/118 |
| 2,016,334 | 10/1935 | McComb | 428/18 |
| 2,111,109 | 3/1938 | Bolyard | 428/18 X |
| 2,447,856 | 8/1948 | Hazelton | 40/124 |
| 2,503,359 | 4/1950 | Smith | 40/19.5 X |
| 2,732,646 | 1/1956 | James | 428/20 |
| 2,865,122 | 12/1958 | Clawson | 40/124 X |
| 3,581,419 | 6/1971 | McCracken | 40/124 |

*Primary Examiner*—John F. Pitrelli
*Attorney, Agent, or Firm*—Flehr, Hohbach, Test, Albritton & Herbert

[57] ABSTRACT

A greeting card display assembly is disclosed herein and utilizes a stack of straight slats to simulate a Christmas tree in both two dimensions and three dimensions and, at the same time, supports greeting cards for display.

7 Claims, 3 Drawing Figures

GREETING CARD DISPLAY ASSEMBLY AND METHOD

BACKGROUND OF THE INVENTION

The present invention relates generally to greeting card displays and more particularly to a specific method of displaying greeting cars using a display assembly which is designed in a specific way to simulate a Christmas tree while, at the same time, reliably support the greeting cards for display.

There have been a number of suggested ways of displaying greeting cards in the prior art as evidenced by the following United States patent Nos.: 516,262 Claflin 2,447,856 Hazelton 2,503,359 Smith 2,865,122 Clawson 3,987,566 March.

The Smith patent just recited discloses an ornamental tree display including a stand, a central core and a series of leaves to be positioned in spaced relationship about the central core. These leaves are provided for supporting greeting cards. In the Clawson patent a tree simulating card display is disclosed and utilizes a pair of triangularly shaped slotted plates to support greeting cards. A slotted pyramid like structure is provided for the same purpose in the March patent. The remaining patents cited above disclose still further arrangements for supporting greeting cards.

Additional ornamental structures, mainly ornamental tree structures (not for displaying greeting cards), are described in the following U.S. patent Nos.: 79,986 Keim 2,016,334 McComb 2,111,109 Bolyard Des 130,937 Dennison 2,732,646 James.

With the exception of Keim, all of the patents just recited disclosure different types of ornamental tree structures. For example, the McComb patent discloses an artificial Christmas tree made up of a series of folded limbs of cellophane of varying lengths designed to be supported upon a central core in spaced relationship. Bolyard utilizes tubes to simulate a tree and Dennison utilizes what appears to be cylindrical rods or sticks. James, on the other hand, provides a knock-down type ornamental tree structure utilizing what are referred to as projecting fingers. The Keim patent is not directed to a tree structure at all, but rather winding stairs utilizing straight bars secured around a central post and other components including, for example, a stair railing.

The various patents cited and discussed above have been provided to exemplify the present state of the art with regard to structures for displaying greeting cards as well as ornamental structures generally and particularly those which simulate Christmas trees. As will be seen hereinafter, the present invention is also directed to a structure (and method) for displaying greeting cards and particularly to a structure which simulates a Christmas tree. However, as will also be seen, the particular structure disclosed herein including the way it displays greeting cards is quite different than the structures discussed above.

OBJECTS AND SUMMARY OF THE INVENTION

One object of the present invention is to provide a greeting card display assembly which simultes a Christmas tree while, at the same time, reliably supports greeting cards for display.

Another object of the present invention is to provide a greeting card display structure which can be easily assembled and disassembled from one season to the next and which can be easily stored in a compact fashion.

Still another object of the present invention is to provide a reliable method of displaying greeting cards utilizing a specifically designed tree simulating structure.

As will be described in more detail hereinafter, the greeting card display assembly disclosed herein and constructed in accordance with the present invention is one which utilizes a plurality of straight slats of progressively decreasing lengths. Each of these slats includes substantially flat top and bottom sides and a centrally located through hole. A vertical post extends successively through these centrally located holes such that the longest slat is nearest to the bottom of the post while the remaining slats successively decrease in size up the post. Moreover, the slats are rotatable about the post for positioning (1) in a common plane so as to simulate a Christmas tree in two dimensions and (2) in angularly different planes so as to simulate a Christmas tree in three dimensions. In addition, the slats are positioned relative to one another such that the confronting sides of any two adjacent slats extend horizontally and slidably engage one another for holding greeting cards therebetween.

DETAILED DESCRIPTION AND PREFERRED EMBODIMENT

Figure 3:
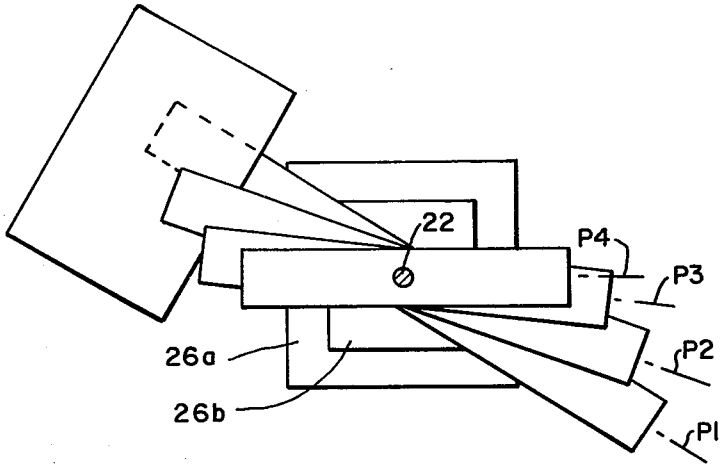
FIG. 3 is a sectional view taken generally along line 3—3 in FIG. 2.
Figure 1:
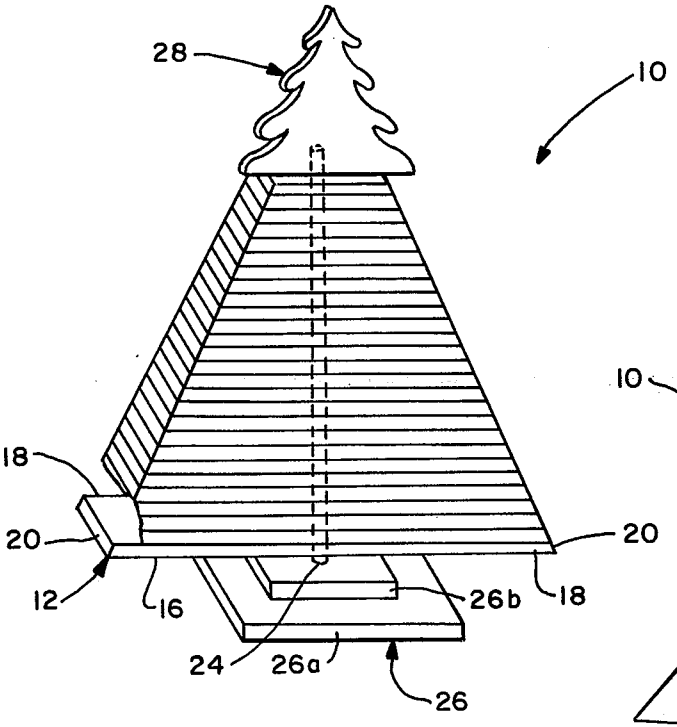
FIG. 1 is a perspective view of a greeting card display assembly which is constructed in accordance with the present invention and which is shown simulating a Christmas tree in two dimensions.

Turning now to the drawing, wherein like components are designated by like reference numerals throughout the three figures, attention is specifically directed to FIG. 1 which illustrates a greeting card display assembly 10 constructed in accordance with the present invention. Assembly 10 includes a plurality of straight slats 12 of progressively decreasing lengths and constructed of any suitable material such as wood or plastic capable of maintaining its shape. Each slat includes a substantially flat top side 14, a substantially flat bottom side 16, side walls 18 and end walls 20 which, for reasons to be discussed, are slightly angled relative to the vertical. In addition, as best seen in FIG. 3, each slat includes a through hole 22 which extends from top side 14 to bottom side 16 and which is centrally located along the length of the slat between end walls 20.

Assembly 10 also includes a cylindrical center post 24, a center post support 26 and a top cap 28, each of which may also be constructed of wood, plastic or the like. As illustrated in FIG. 1, the center post extends successively through the centrally located holes 22 of each slat and includes both a bottom end section and a top end section respectively extending beyond the lowermost and the uppermost slats. The bottom end section is disengageably mounted within a cooperating opening through support 26 while the top end section is disengageably inserted within a cooperating opening in top cap 28. In this way, slats 12 are longitudinally fixed along center post 24 and cannot slide off either end thereof. However, as will be seen hereinafter, these slats are rotatable about the axis of the center post.

The center post support 26 can be any suitable shape for supporting center post 24 such as the two blocks illustrated in FIG. 1, a relatively large bottom lock 26*a* and a thicker but smaller top block 26*b*. Top cap 28 not only serves as a stop at the top end of center post 24 but also as part of the ornamental configuration of the display assembly. More specifically, as illustrated in FIG. 1, end cap 28 is in the shape of a Christmas tree or top section of a Christmas tree and cooperates with the slats to this end. While this shape is preferred and actually provided in actual embodiment, it is to be understood that other shapes could be utilized.

As stated previously, slats 12 are of decreasing lengths. Moreover, as seen in FIG. 1, these slats are positioned along the length of center post 24 relative to one another such that the largest slat is nearest the bottom of the post with the remaining slats successively decreasing in size up the post. In addition, these slats are rotatable about the post for positioning (1) in a common plane through the post so as to simulate a Christmas tree in two dimensions as illustrated in FIG. 1, and (2) in angularly differing planes through the post (to be described with respect to FIG. 2) so as to simulate a Christmas tree in three dimension. In both cases, these slats are positioned relative to one another such that the confronting horizontal sides of any two adjacent slats, specifically the top side 14 of one slat and the bottom side 16 of the next upper slat, slidably engage one another for holding a greeting card or greeting cards therebetween, as will be seen. In a preferred embodiment, when the slats are in the FIG. 1 position for simulating a Christmas tree in two dimensions, the adjacent ends 20 on each side of the post together define a substantially flat and substantially continuous surface from the lowermost slat to the uppermost slat.

Figure 2:
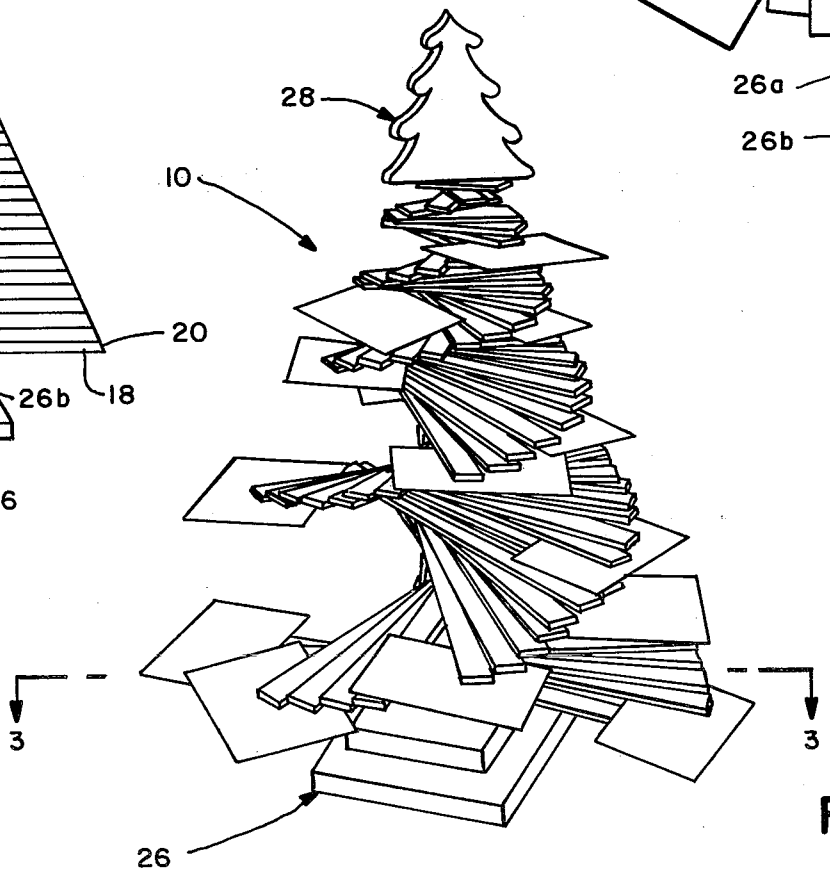
FIG. 2 is a perspective view of the tree illustrated in FIG. 1 but shown simulating a Christmas tree in three dimensions.

In order to simulate a Christmas tree in three dimensions as illustrated in FIG. 2, the successive slats starting with the lowermost slat are angularly positioned relative to one another, that is, they are placed in angularly different planes progressively located about the axis of center post 22. This is best seen in FIG. 3. Note that the lowermost slat is positioned within a vertical plane P1 through the center post, the second slat is positioned in plane 2, the third slat in plane 3 and the fourth slat in plane 4. Also note that these planes are progressively positioned around the center post 22. The remaining slats progress in the same manner as best illustrated in FIG. 2.

As stated previously, the slats are positioned relative to one another so that the confronting sides of any two adjacent slats slidably engage one another. This is true whether the slats are positioned in a single plane as illustrated in FIG. 1 or the varying planes illustrated in FIGS. 2 and 3. Hence, in either of these positions, greeting cards generally indicated at 30 can be located between any two adjacent slats and readily viewed by an observer, particularly when the display is in its three-dimensional position.

What is claimed is:

1. A greeting card display assembly, comprising:

(a) a plurality of straight slats of progressively decreasing lengths, each of said slats including
  (i) a substantially flat top side,
  (ii) a substantially flat bottom side, and
  (iii) a through hole extending from said top side to said bottom side and centrally located along the length of the slat;

(b) a vertical center post extending successively through said centrally located holes of said slats such that
  (i) the largest one of the said slats is nearest to the bottom of said post with the remaining slats successively decreasing in size upwardly along the length of said post,
  (ii) said slats are rotatable about said post for positioning in a common plane through said post to simulate a Christmas tree in two dimensions and in angularly differing planes through said post to simulate a Christmas tree in three dimensions, and
  (iii) any two adjacent slats are positioned relative to one another so that their confronting sides extend horizontally and slidably engage one another for holding a greeting card therebetween; and (c) means for supporting said post in a vertically extending position.

2. An assembly according to claim 1 wherein said post includes a section which extends up beyond the uppermost one of said slats, said assembly including a top cap mounted around and hiding the top section of said post and preventing said slats from sliding off of said post at its top end.

3. An assembly according to claim 2 wherein said top cap is in the shape of a Christmas tree.

4. An assembly according to claim 3 wherein said post supporting means and said top cap are disengageably connected with said post.

5. An assembly according to claim 4 including greeting cards supported between said slidable surfaces.

6. An assembly according to claim 2 wherein the adjacent ends of said slats on each side of said post together define a substantially flat and substantially continuous surface when said slats are positioned in said common plane so as to simulate a Christmas tree in two dimensions.

7. A method of displaying greeting cards, comprising:

(a) providing a plurality of straight slats of progressively decreasing lengths, each of said slats including
  (i) a substantially flat top side,
  (ii) a substantially flat bottom side, and
  (iii) a through hole extending from said top side to said bottom side and centrally located along the length of the slat;

(b) placing a vertical center post successively through said centrally located holes of said slats such that
  (i) the largest one of said slats is nearest to the bottom of said post with the remaining slats successively decreasing in size upwardly along the length of said post,
  (ii) said slats are rotatable about said post for positioning in a common plane through said post to simulate a Christmas tree in two dimensions and in angularly differing planes through said post to simulate a Christmas tree in three dimensions,
  (iii) any two adjacent slats are positioned relative to one another so that their confronting sides extend horizontally and slidably engage one anohter for holding a greeting card therebetween, and (iv) said post includes a top end section which extends up beyond the uppermost one of said slats;

(c) supporting said post in a vertically extending position;

(d) mounting a top cap around said top post section to hide the latter and prevent said slats from sliding off of the post at its top end;

(e) rotating said slats so as to position them in said angularly differing planes; and (f) placing greeting cards between certain ones of said slidable surfaces for support therebetween.

* * * * *